US006575175B2

(12) United States Patent
Kim et al.

(10) Patent No.: US 6,575,175 B2
(45) Date of Patent: Jun. 10, 2003

(54) BRAIDING MACHINE

(75) Inventors: Bong H. Kim, Fort Lee, NJ (US); Tae W. Kim, Fort Lee, NJ (US); Jiang Yingxiu, Teterboro, NJ (US)

(73) Assignee: AMG Industries, Inc., Teterboro, NJ (US)

( * ) Notice: Subject to any disclaimer, the term of this patent is extended or adjusted under 35 U.S.C. 154(b) by 0 days.

(21) Appl. No.: 10/007,688

(22) Filed: Oct. 22, 2001

(65) Prior Publication Data

US 2003/0075198 A1 Apr. 24, 2003

(51) Int. Cl.[7] ..... A45D 1/00
(52) U.S. Cl. ..... 132/210; 132/212
(58) Field of Search ..... 132/210, 212, 132/273, 271, 56; 87/8, 13, 33, 62, 25; 446/472, 259; 242/442, 390.8

(56) References Cited

U.S. PATENT DOCUMENTS 3,421,406 A 1/1969 Mitchell et al.
4,038,996 A 8/1977 Eronini et al.
4,307,737 A 12/1981 Shipman
4,369,690 A 1/1983 Sapkus
4,427,017 A 1/1984 Eronini
4,583,561 A * 4/1986 Larsson ..... 132/212
5,988,181 A 11/1999 Gable et al.
6,164,289 A * 12/2000 Ogunro ..... 132/210
6,499,491 B2 * 12/2002 Kennedy et al. ..... 132/212

* cited by examiner

*Primary Examiner*—John J. Wilson
*Assistant Examiner*—Robyn Kieu Doan
(74) *Attorney, Agent, or Firm*—Bradley Ruben, PL

(57) ABSTRACT

The present invention includes a braiding machine having three or more vessels, each vessel having an outer housing and an internal telescoping mandrel, the vessels being removably mounted on a portion of two wheel drums, the drums rotating and the direction of each vessel around the drum being altered by a toggling detent. To use the device, hair is wrapped onto an extended telescoped mandrel, the mandrel is collapsed, and a housing is placed on the mandrel to provide a vessel; three or more vessels are then mounted onto the drums and, when the device is powered, the hair on the mandrels emerges from the device as a braid.

16 Claims, 7 Drawing Sheets

BRAIDING MACHINE

BACKGROUND

1. Field of Invention.

The instant invention relates to a braiding apparatus.

2. State of the Art.

Hair braiding is one of the oldest forms of enhancing a person's physical appearance. More than simply pulling the hair back to reveal the attractive features of the face, braiding adds a decorative pattern that adds to the individual's natural beauty.

Today, there are a number of known braiding machines. Sapkus, U.S. Pat. No. 4,369,690, discloses a hand-operated hair braiding machine wherein three passages through which hair is drawn are alternately rotated to braid the hair. Each of the passages is disposed in an elliptical gear. The combination of a pinion gear member with its axel disposed in a slot, and a toggling pawl, combine to effect the braiding motion of the elliptical gears.

Gable et al., U.S. Pat. No. 5,988,181, also discloses a hand-operated hair braiding machine providing three passages for hair as cylindrical filament holders, in which cranking a lever mechanically moves the holders to affect the braiding motion.

Shipman, U.S. Pat. No. 4,307,737, discloses a device similar to that of Gable et al., wherein a lever in combination with an aperture is used to effect movement of the hair passage cylinders.

Other patents, to Eronini, U.S. Pat. No. 4,038,996 and 4,427,017, and Mitchel, U.S. Pat. No. 3,421,406, are relevant to the extent they provide other mechanisms for braiding, including hand-held devices for braiding hair on one's head.

Additionally, braiding is not limited to hair alone. Braiding is useful in the textile industry, and can even be extremely effective in the rope and cable industries. Long ago, it was found that by twisting strands of metal wire the strength of the resulting article was greater than the sum of the strengths of the individual strands. Braiding further enhances the strength of the resulting article because the individual strands are interlocked. If it were possible to find a cost effective and efficient method of braiding strands of metal wire, cables could be produced with substantially enhanced strength and weight capacities.

OBJECTS AND SUMMARY OF THE INVENTION

Accordingly, it is an object of the present invention to provide an effective and dependable braiding machine.

Another object of the present invention is to provide a braiding machine design that is effective in braiding anything from strands of hair for enhancing a persons physical beauty to strands of metal wire for support cables.

The instant invention includes a braiding machine having three or more vessels, each vessel having an outer housing and an internal telescoping mandrel, the vessels being removably mounted, preferably on a portion of two wheel drums, the drums rotating and the direction of each vessel around the drum being altered by a guide. To use the device, strands of hair, fiber, or wire are inserted into an extended telescoped mandrel, the mandrel is collapsed, and a housing is placed on the mandrel to provide a vessel; three or more vessels are then mounted onto the drums and, when the device is powered, the strands in the mandrels emerge from the device as a braid.

DETAILED DESCRIPTION

With reference now to the figures and, in particular, with reference to FIGS. 1–7, there is depicted a representation of a braiding machine of the present invention. The braiding machine of the present invention can be utilized for braiding practically any relatively long fiber material, ranging from strands of hair for enhancing a persons physical beauty to strands of metal wire for support cables. The various changes and modifications needed for the various materials to be braided are well within the knowledge of one of ordinary skill in the art.

Figure 1:
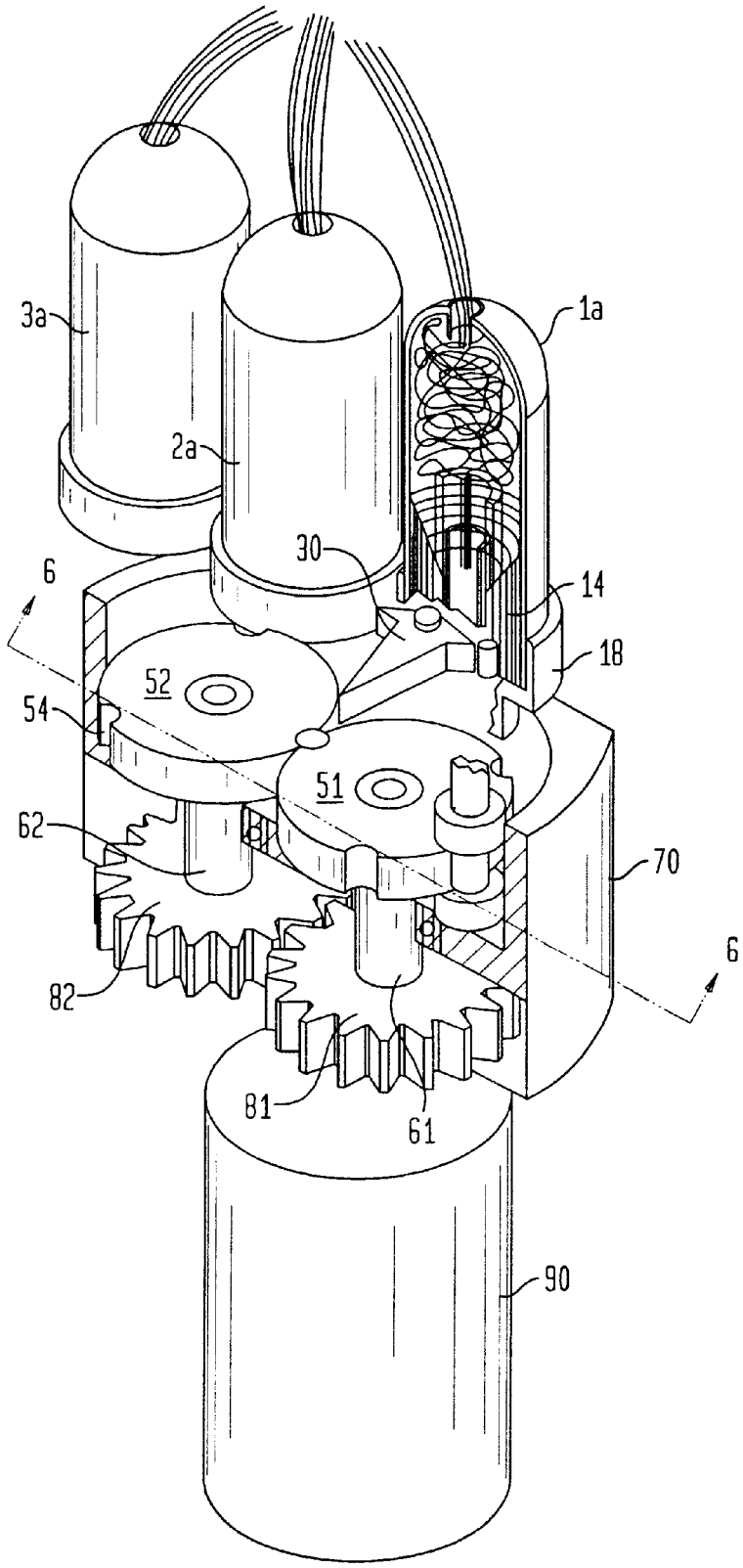
FIG. 1 depicts the braiding machine of the present invention.
Figure 2:
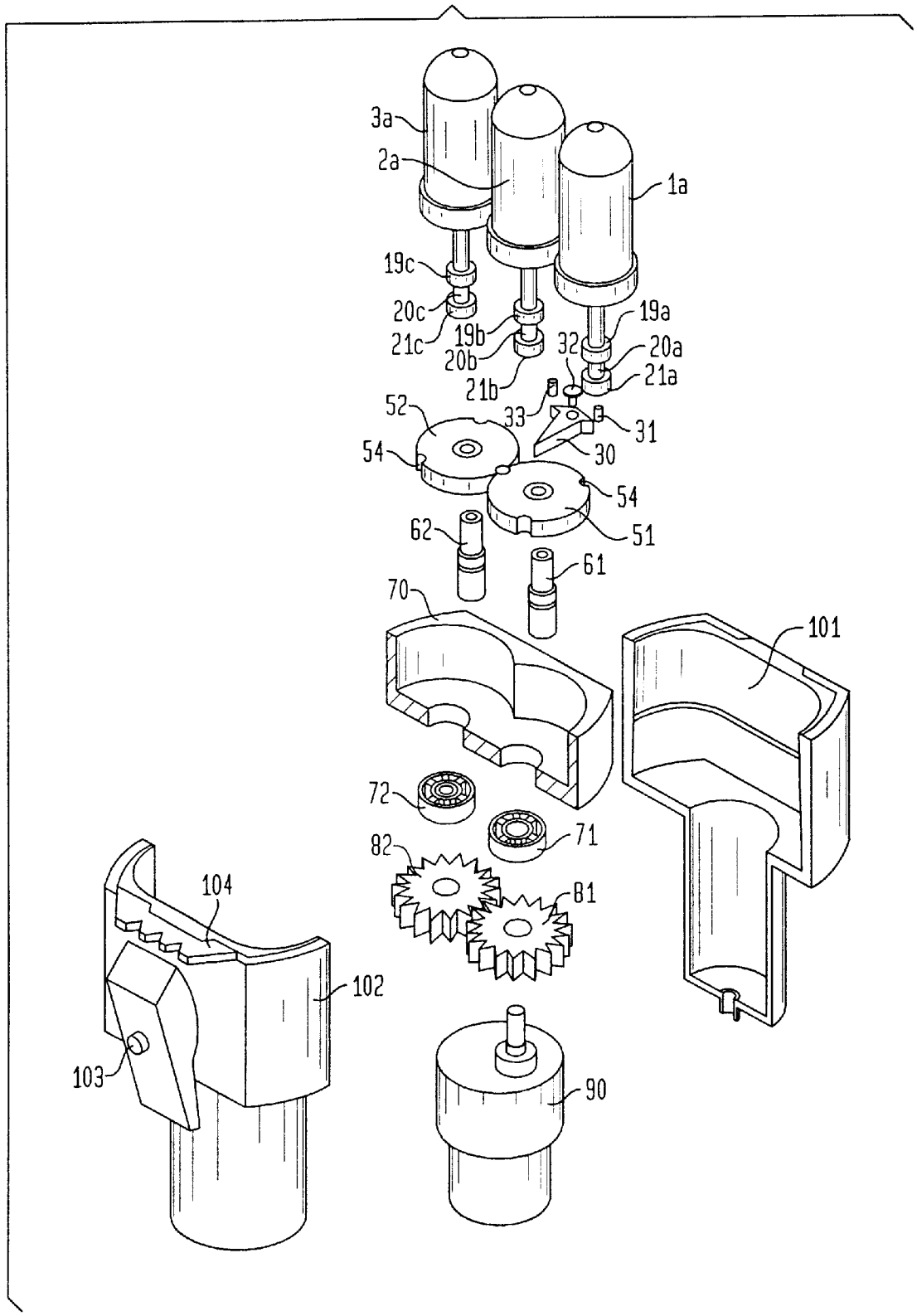
FIG. 2 depicts an exploded view of the braiding machine of the present invention.

The braiding machine (FIGS. 1 and 2) includes a motor 90, which drives a first gear 81 that in turn drives a second gear 82. Other devices that convey motion can be substituted for the gears, and the motor can be replaced by mechanical, pneumatic, magnetic, electrical, and other devices capable of providing the necessary motion. The first gear and second gear, rotating counter to one another, drive a drive shaft 61 and a side shaft 62, respectively. The drive shaft and the side shaft drive a first drum 51 and a second drum 52, respectively, which are supported within an inner casing 70. Naturally, the drums need not be disc shaped, as depicted in FIGS. 1, 2, and 6, but can be made in a star shape, with spokes, or any shape that can provide the necessary planetary shaft support and synchronism. In FIG. 2, an outer casing is shown including two sections 101, 102, as well as a power activation switch 103 and a comb 104. After the strands have been combed or otherwise arranged into three or more bundles, the comb is used to hold the bundles prior to insertion of the each of the bundles into the respective vessel. In the case of hair, for example only and not to be limited thereto, the hair is combed and separated into three or more bundles, each of which are placed in a separate groove of the comb 104. The bundles are held in place, and one by one inserted into the respective vessels, to be described below.

Figure 3:
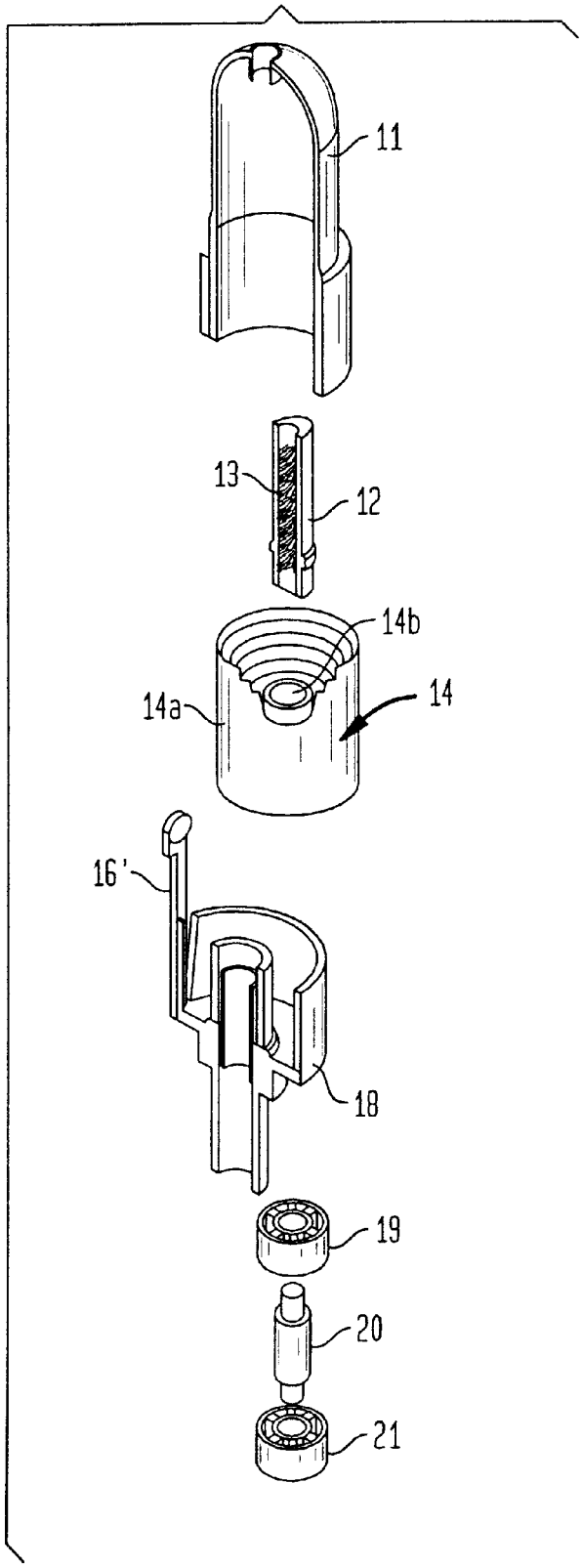
FIG. 3 depicts an exploded view of a vessel of the present invention.
Figure 4:
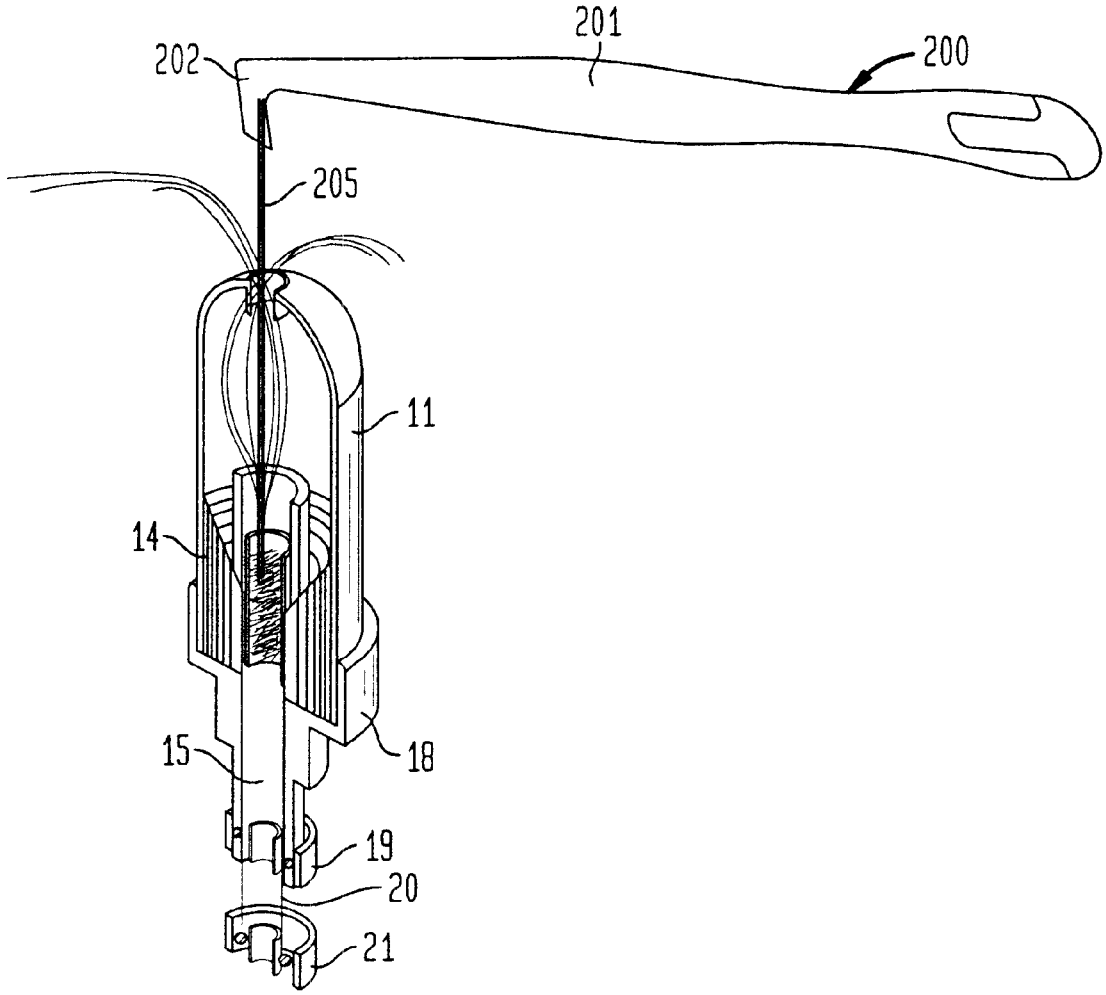
FIG. 4 depicts the vessel including strands to be braided.
Figure 5A:
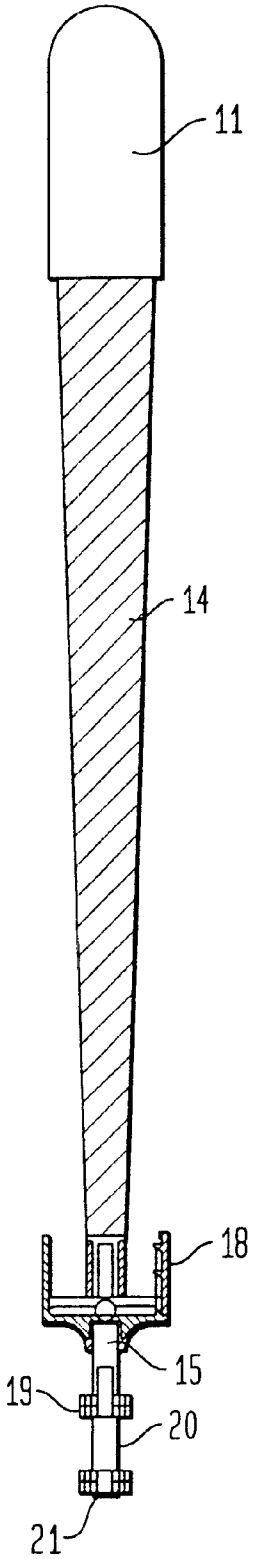
FIG. 5*a* depicts the vessel in an extended position.
Figure 5B:
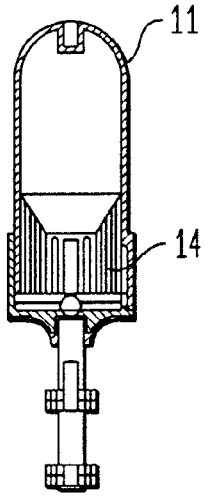
FIG. 5*b* depicts the vessel in an contracted position.

The rotation of the drums is translated, via a plurality of planet shafts 20 held in a plurality of grooves 54 on the drums, to at least three vessels 1*a*, 2*a*, 3*a*. Naturally, in order to provide unhindered rotational movement of the various components, bearings are included as well. With reference to FIG. 3, the vessels of the present invention are generally comprised of a cylinder 11 and a sheath 18, which include a tape spring 14 (telescoping mandrel) having an outer surface 14*a*, which is frictionally and releasably engaged with the inner surface of the cylinder, and an inner core 14*b*, which is attached to the sheath. In this way, the tape spring can be extended in order to enlarge the interior volume, depending on the length of the strands to be braided (FIGS. 5*a* and 5*b*). Brush cylinder 12 is attached to the sheath through the inner core of the tape spring. A brush 13 is positioned within the brush cylinder for gently and releasably holding the bundle of strands inserted into the vessel during the braiding process.

In order to permit release of the cylinder from its position within the sheath, a locking lever 16' is provided. Locking and unlocking is a simple matter of applying a small force to the lever which applies or releases pressure on the lower part of the cylinder. This mechanism can alternatively be in the form of a frictional engagement, spring loaded, or any device or arrangement that would permit releaseable engagement of the cylinder 11 within the sheath 18.

Figure 6B:
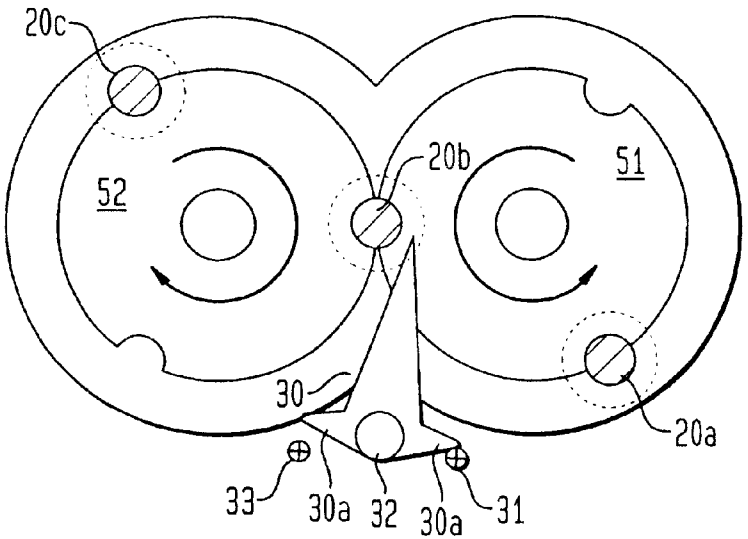
FIG. 6*b* is a cross-section taken along line 6—6 of FIG. 1 depicting the first and second wheel drum in a second position.
Figure 6A:
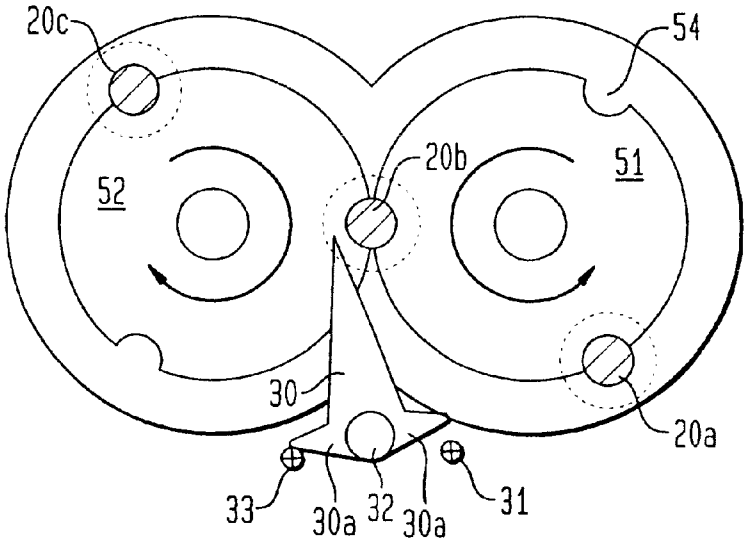
FIG. 6*a* is a cross-section taken along line 6—6 of FIG. 1 depicting a first and second wheel drum of the present invention in a first position.

FIGS. 6*a* and 6*b* are a cross-section taken along line 6—6 of FIG. 1 showing, for example only and not to be limited thereto, three vessels 1*a*, 2*a*3*a*, and accordingly three planetary shafts 20*a*, 20*b*, 20*c* (FIG. 2). Each wheel drum 51, 52 includes three grooves 54 positioned at 120° intervals for receiving the planetary shafts. As the drums rotate, a planetary shaft 20*b* approaches a position directly between the two drums, at which point a guide 30 directs and positions the planetary shaft on the other drum. The guide, for example only, may be in the form of a toggling detent. As the planetary shaft continues past the switch off point, it engages a flange like portion 30*a* so as to position the guide for the next planetary shaft. Additionally, in order to provide for an efficient and dependable mechanism, control bars 31, 33 are positioned so as to limit the movement of the guide.

Figure 7:
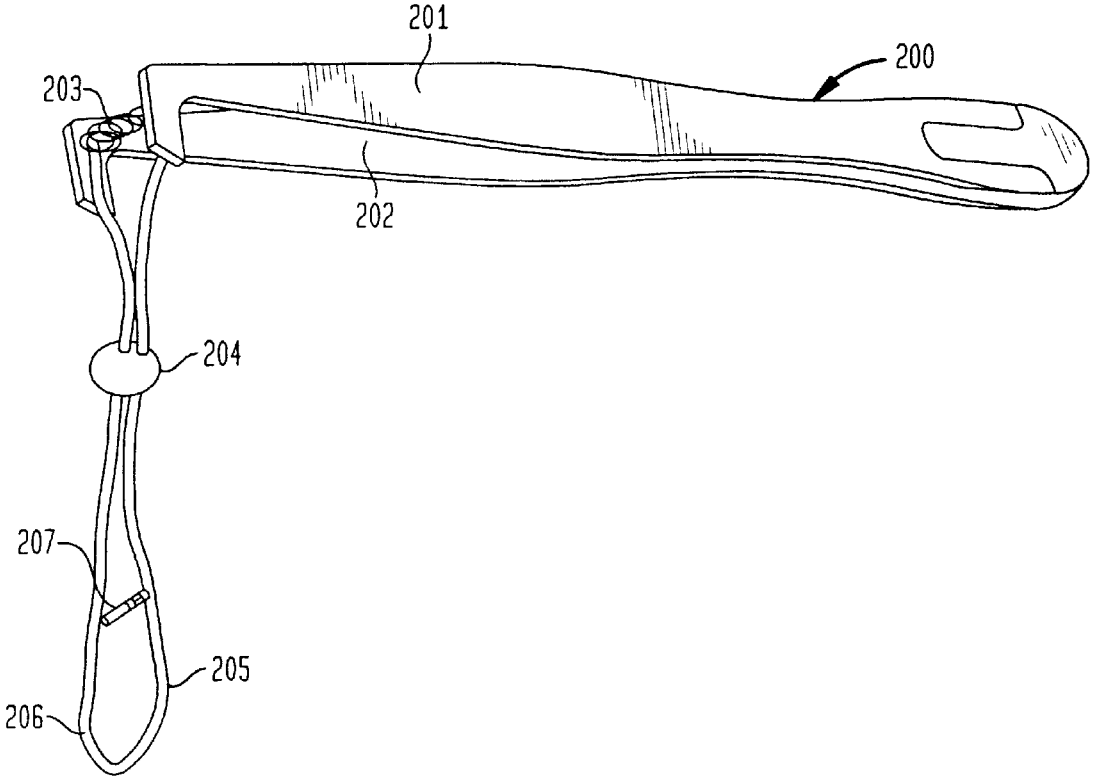
FIG. 7 depicts a pair of forceps of the present invention.

As shown in FIG. 7, specialized forceps 200 may be utilized for the insertion of individual bundles into the vessel, while it is understood that a skilled artisan in the art may utilize other methods and tools. The specialized forceps of the present invention include a first and second gripping handles 201, 202, with a first and second extension 205, 206, respectively. A spring 203 positioned between the gripping handles is adapted for biasing the first and second extensions together, and hence in a closed position. When the handles are gripped loosely, the extensions are in a closed position, and when the handles are gripped firmly, or squeezed, the extensions are in an open position, or separated. In order to facilitate additional control a guide ring 204 and a bar or control spring 207 are provided. The guide ring is slidable along the length of the extensions, and provides additional control in varying the relative position of the extensions to one another. The control spring is advantageous in stabilizing the extensions and prevent their twisting.

In operation (FIG. 4), the strands are combed or properly arranged and divided into three or more bundles. Each bundle is placed within a notch of the comb 104, and while being held in position, the ends of each of the bundles are consecutively grasped by the forceps 200 between the first and second extensions 205, 206. Using the forceps, each bundle end is inserted through a cylinder 11, and into the brush cylinder 12 within the core of the tape spring. The bundle ends are caught and held in place by the brush 13, which allows the tape spring to be extended until the cylinder reaches the roots, when working with hair for example only. Pulling up the cylinder to the roots of the bundles, the tape spring is to be extended, providing the enlarged space in which all hairs of the bundle are to be put. By bringing up the body of the braiding machine to the cylinder and collapsing the extended tape string, the cylinder is to be put in the sheath again, and all hairs of the bundles are thus contained in the cylinder. Once this is accomplished, the switch is actuated, the braiding process begins, and all the of hair bundles are braided to their ends. The braided bundles then can be gently pulled out of the brush core, and the process is complete.

As implied from the background section, while the present invention has been described with respect to the braiding of human hair, the general mechanism is suitable for braiding wire, natural and/or synthetic fibers, and combinations thereof. In such cases, preferably those fibers and/or wires are provided on a spool. In addition, whether hair, wire, or fiber, more than three vessels can be used to braid.

The forgoing description is meant to be illustrative and not limiting. Various changes, modifications, and additions may become apparent to the skilled artisan upon perusal of this specification, and such are meant to be within the scope and spirit of the invention as defined by the claims.

What is claimed is:

1. A braiding apparatus comprising:

a. a plurality of vessels, each of said vessels retaining a bundle of strands to be braided;

b. a plurality of shafts attached to said plurality of vessels, respectively;

c. a first drum and a second drum, each of said first drum and said second drum having a plurality of grooves for receiving said plurality of shafts, wherein said plurality of grooves is greater in number than said plurality of shafts; and d. means for providing rotational motion to said first drum and said second drum, so that said first drum and said second drum convey said rotational motion to said plurality of shafts, so that said plurality of shafts convey said rotational motion to said plurality of vessels, thereby braiding said bundle of strands retained by each of said vessels.

2. The braiding apparatus of claim 1, further including a guide for guiding said plurality of vessels from said first drum to said second drum and/or from said second drum to said first drum.

3. The braiding apparatus of claim 2, wherein said vessels are conducted in a figure-eight path of motion.

4. The braiding apparatus of claim 2, wherein said guide is a toggling detent.

5. The braiding apparatus of claim 2, wherein at least one of said plurality of shafts moves said guide from a first position to a second position.

6. The braiding apparatus of claim 4, further including control members for limiting movement of said guide.

7. The braiding apparatus of claim 1, wherein at least one of said plurality of vessels includes a cylinder for retaining said bundle of strands.

8. The braiding apparatus of claim 7, further comprising a sheath attached to at least one of said plurality of shafts and said cylinder.

9. The braiding apparatus of claim 8, further comprising a tape spring.

10. The braiding apparatus of claim 9, wherein said tape spring includes an outer surface attached to said cylinder and an inner core attached to said sheath, wherein said tape spring is extended so as to enlarge an interior volume to accommodate longer strands of said bundle of strands.

11. The braiding apparatus of claim 8, further including a brush cylinder positioned between said sheath and said cylinder.

12. The braiding apparatus of claim 11, wherein said brush cylinder includes a brush for releasably retaining ends of said bundle.

13. A method of braiding comprising the steps of:

a. providing at least three vessels, b providing at least three bundles of strands, wherein each of said bundles includes at least one strand, and placing each of said bundles into each of said vessels;

c. providing at least three shafts, attaching said shafts to said vessels, respectively;

d. providing a first drum and a second drum, each of said first drum and said second drum having a plurality of grooves for receiving said plurality of shafts; and e. providing rotational motion to said first drum and said second drum, so that said first drum and said second drum convey said rotational motion to said shafts, so that said shafts convey said rotational motion to said vessels, thereby braiding said bundle of strands retained by each of said vessels.

14. The method of braiding of claim 13, further comprising the step of guiding said vessels from said first drum to said second drum and/or from said second drum to said first drum.

15. The method of braiding of claim 13, further comprising the step of moving said guide from a first position to a second position and limiting movement of said guide.

16. The method of braiding of claim 13, further comprising the step varying the internal areas of said plurality of vessels so as to accommodate varying lengths of said bundles.

* * * * *